United States Patent [19]

Rodriquez et al.

[11] Patent Number: 4,463,537

[45] Date of Patent: Aug. 7, 1984

[54] CLIP FOR SUSPENDING CEILING PANELS

[75] Inventors: Daniel V. Rodriquez, Inglewood; Roger S. Daniels, Santa Monica, both of Calif.

[73] Assignee: Integrated Ceilings, Inc., Los Angeles, Calif.

[21] Appl. No.: 343,724

[22] Filed: Jan. 29, 1982

[51] Int. Cl.[3] ..... E04B 5/52

[52] U.S. Cl. ..... 52/489; 52/486; 52/484; 52/762; 52/714

[58] Field of Search ..... 52/484, 485, 486, 489, 52/359, 509, 714, 762, 144

[56] References Cited

U.S. PATENT DOCUMENTS

| | | | |
|---|---|---|---|
| 1,507,652 | 9/1924 | Youngberg | 52/484 X |
| 2,370,379 | 2/1945 | Trippensee | 52/486 X |
| 2,785,099 | 3/1957 | Holtsford | 52/144 X |
| 2,924,856 | 2/1960 | Price | 52/144 |
| 3,110,373 | 11/1963 | Adams | 52/714 X |
| 3,212,224 | 10/1965 | Spangenberg | 52/762 X |
| 3,934,387 | 1/1976 | Moeller | 52/489 |
| 4,117,641 | 10/1978 | Wells | 52/489 X |
| 4,155,206 | 5/1979 | Player | 52/489 X |
| 4,333,291 | 6/1982 | Musgrave et al. | 52/486 X |

FOREIGN PATENT DOCUMENTS

| | | | |
|---|---|---|---|
| 1034733 | 7/1978 | Canada | 52/489 |
| 211301 | 2/1967 | Sweden | 52/485 |
| 579690 | 9/1976 | Switzerland | 52/486 |
| 2007751A | 5/1979 | United Kingdom | 52/714 |

*Primary Examiner*—Henry E. Raduazo

*Attorney, Agent, or Firm*—Poms, Smith, Lande & Rose

[57] ABSTRACT

A device for use with a ceiling panel retaining grid to suspend a ceiling panel a desired distance below the grid, the device having a panel engaging clip or extension for allowing the attachment of the device to the panel, a hook element for removeably attaching the device to the grid, and an appropriate extension between the panel engaging portion and hook element sufficient to separate the two so as to allow suspension of the panel a specified distance below the grid. The hook element engages the grid in a manner to allow the panel, while suspended below the grid, to be lifted, thereby allowing access to the sides and associated devices of adjacent ceiling panels. The device may be disengaged from the grid by application of a force against it substantially parallel to the plane formed by the ceiling panel.

18 Claims, 8 Drawing Figures

CLIP FOR SUSPENDING CEILING PANELS

BACKGROUND OF THE INVENTION

1. Field of the Invention

This invention relates to devices suitable for suspending panels a desired distance below a grid of ceiling panel retainers.

2. Description of Prior Art

Suspended ceiling panel systems have enjoyed wide popularity in the recent past. Such systems allow for the easy installation of an aesthetically pleasing and, if desired, acoustically absorbent ceiling in commercial and residential buildings, without the considerable time, labor, and expense associated with previous semi-permanent or permanent ceiling installations. Typically, such suspended ceilings consist of a grid of ceiling panel retainers which are wired to or otherwise attached a desired distance below the permanent ceiling of the building. Any of a variety of ceiling panels may be placed into the grid openings, thereby concealing the various unsightly elements of a building's utility systems such as air conditioning and heating ducts, electrical wiring, and plumbing lines, all commonly installed above a suspended ceiling system and below the permanent ceiling. Inasmuch as the ceiling panels are set onto the grid system and not affixed thereto, they are easily removed when it necessary to inspect, repair, or modify the building utility systems found above the suspended ceiling.

Due to the popularity of such suspended ceiling systems, many different types of panels are available from a number of manufacturers, offering the interior designer a variety of colors, designs and configurations for such ceiling panels. Additionally, there has been a standardization in the industry of the design of the grid of panel retainers, thereby allowing use of any of a variety of different types of panel designs with a previously installed grid of ceiling panel retainers.

The typical grid of panel retainers consists of a number of inverted T-bar shaped beams joined via appropriate fasteners to create a grid having openings slightly smaller than the panels to be used. Each side of a panel is set on a flange of one of the beams in the grid, thereby supporting the panel in the grid, yet facilitating easy removal of it by lifting it above the grid and withdrawing it through the grid opening. The beams and connectors are typically suspended below the permanent ceiling via a number of wires or braces.

With the above-described design, the lower surfaces of the flanges of the grid system beams are visible from below. Although generally unobjectionable, certain desirable panel designs may conflict with the appearance of the typical grid system. In addition, it is sometimes desired to use new ceiling panels whose design conflicts with the normally visible portion of an existing grid system. It has been of considerable concern in the industry to devise a technique allowing modernization or updating of an existing suspended ceiling system by substitution of the ceiling panels with new panels having a new design, without incurring significant additional cost or labor by the installation of a new grid system more visually compatible with the new panel design.

One method is to conceal the lower surfaces of the grid flanges by screwing or riveting the decorative ceiling panel to the grid flanges. Obviously, although the grid may be concealed in such a manner, the screws or rivets are visible. Further, easy removal of a ceiling panel is hindered since each screw or rivet attaching the panel to the grid must be individually removed.

It is therefore an object of the present invention to provide panel clips suitable for positioning a decorative ceiling panel a predetermined distance below a ceiling grid formed by inverted T-bar shaped beams, thereby permitting the decorative ceiling panels to conceal the grid system.

A further object of the present invention is to provide such a clip which is easily attachable and detachable from the grid beams without the need for special tools, thereby facilitating ready removal and installation of the decorative ceiling panels.

It is an additional object of the invention to allow use of such a clip without requiring the modification of an existing ceiling grid system.

Further, it is an object to provide a ceiling panel clip which will allow an otherwise unsupported ceiling panel to hang by the clip thereby allowing access to the area above the grid while having the ceiling panel remain partially attached to the grid system.

SUMMARY OF THE INVENTION

These and other objects are provided for by the present invention which has at one end an element suitable for securely engaging a side of a ceiling panel and a hook element located at the other end suitable for removably attaching to an existing ceiling panel grid. The hook and panel engaging elements are separated by a specified distance to allow the ceiling panel to be suspended below the grid system by a predetermined distance. The invention allows the ceiling panel to be lifted toward the grid, thereby allowing access to the sides and associated panel clips of adjacent panels. Furthermore, the inventive device is disengagable from the grid by application of a force against its side, thereby allowing ready disconnection or removal of a ceiling panel from the grid system.

In one embodiment, the panel engaging element is a clip which semipermanently attaches to the panel. Alternatively, in another embodiment, a suitably shaped tab is permanently fastened onto the panel.

In another embodiment of the invention, the grid system contains a suitable receptacle for the end of the device which contacts the grid system to allow for the "hanging" of a ceiling panel below a grid system when access above this ceiling panel is desired.

DESCRIPTION OF THE PREFERRED EMBODIMENT

Figure 1:
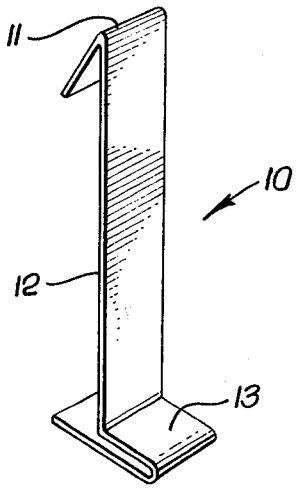
FIG. 1 is a perspective view of one embodiment of the invention.

The present invention provides a clip suitable for use in semi-permanently suspending a ceiling panel below a ceiling panel grid system. FIG. 1 is a perspective view of one embodiment of the invention. A ceiling panel suspension clip 10 may be formed from a unitary flat piece of elongated rectangular shape of a rigid material such as metal or plastic. A J-shaped hook 11 is formed at one end. At the other end, a panel clip 13 is formed by sharply bending the unitary piece back upon itself so as to form a horizontal groove which is employed to grip a thin edge of a ceiling panel. The center portion of the suspension clip 10 contains a vertical portion or extension 12 between the hook 11 and panel clip 13 portions. This vertical portion 12 is of size to suitably lower an attached ceiling panel below the grid system by a desired distance.

Figure 2:
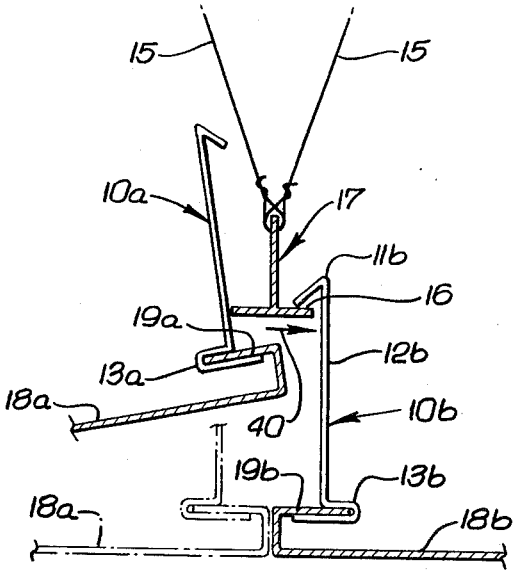
FIG. 2 is a side sectional view of the embodiment of the invention illustrated in FIG. 1 as may be used in conjunction with a ceiling panel and inverted T-bar grid system.

FIG. 2 is a sectional view of a portion of a panel system using the embodiment of the invention illustrated in FIG. 1. An inverted T-bar shaped beam 17 is shown in sectional view. This beam 17 is suspended via one or more wires 15 which are suitably attached to the permanent ceiling of the structure containing the suspended ceiling grid. The grid system typically contains a number of such inverted T-bar beams 17 formed into a regular pattern suitably shaped to correspond with the planar dimensions of ceiling panels 18*a*, 18*b*.

FIG. 2 illustrates two of the inventive suspension clips 10*a*, 10*b* attached to two ceiling panels 18*a*, 18*b* respectively. Each of the suspension clips 10*a*, 10*b* contacts and is supported by the beam 17 at the top surface of its flange 16. Suspension clip 10*a* and associated ceiling panel 18*a* illustrate the manner in which the suspension clips permit the ceiling panels to be lifted toward the grid system 17, allowing access to the side of an adjacent ceiling panel 18*b* and associated suspension clip 10*b*. Each of the ceiling panels 18*a*, 18*b* may contain a thin, L-shaped inwardly extending flange or extension 19*a*, 19*b* a small distance above the body of the ceiling panel and attached thereto. As illustrated, ceiling panel 18*b* has its flange 19*b* fitted into the panel clip 13*b* of the suspension clip 10*b*. The side of the ceiling panel 18*b* is held a suitable distance below that of the grid beam 17 as determined by the length of the vertical portion 12*b* of the suspension clip 10*b*.

Suspension clip 10*b* is disconnectable from the suspension grid 17 by application of a force to the side of the clip 10*b* in a direction shown by an arrow 40. Such a force causes the clip 10*b* to bend back and free the hook end 11*b* from the flange 16 of the beam 17. In one embodiment of the invention, the suspension clip 10*b* is made of a spring-like metal material, such as 26 gauge spring steel, and is configured so that the vertical portion 12*b* is substantially perpendicular to the plane of the ceiling panel to which it is attached. Application of force to the side of the suspension clip 10*b* overcomes the spring force of the clip 10*b*, allowing disengagement of the clip 10*b* from the ceiling grid system. Removal of the force causes the clip 10*b* to return to a substantially perpendicular direction to the ceiling panel to which it is attached.

Figure 3:
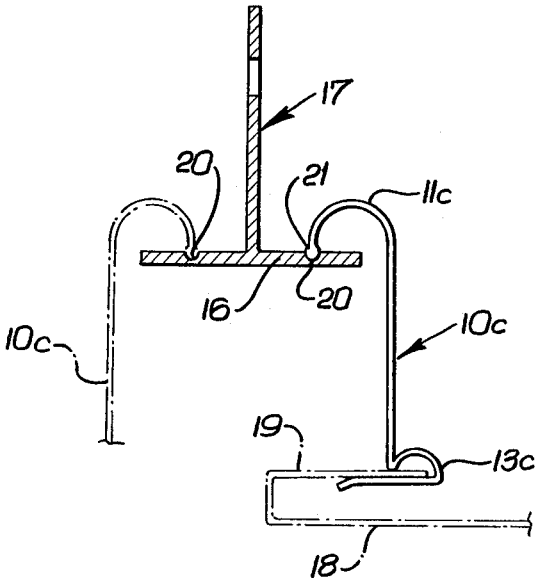
FIG. 3 is a side sectional view of another embodiment of the invention, illustrating an alternative hook end suitable for retention in the flange of an inverted T-bar grid system and an alternative panel clip end.

FIG. 3 is a sectional view of another embodiment of the invention illustrating the manner in which a suspension clip 10*c* may be suitably adapted for engagement with an inverted T-bar grid system. The clip includes a hook portion 11*c* which contains a substantially cylindrical boss 21 at the end thereof. This boss 21 is of shape and size to suitably engage a groove 20 in the upper surface of the flange 16 of the inverted T-bar beam 17. Such a groove 20 may consist of an elongated indentation in the flange 16.

Also illustrated in FIG. 3 is another possible shape for forming the clip end 13*c* of the suspension clip 10*c*. As may be readily seen, the illustrated shape of the panel clip will suitably pinch the inward extension 19 of a ceiling panel 18 so as to suitably attach the suspension clip 10*c* to the ceiling panel 18.

Figure 5:
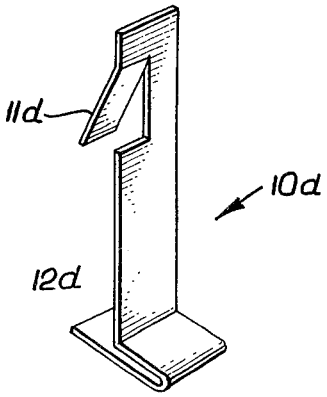
FIG. 5 is a perspective view of a further embodiment of the invention, illustrating a hook-like extension formed by a flap from a portion of the inventive device.

Of course, the invention should not be limited to the desecribed shapes for the panel clip or hook inasmuch as any of a variety of shapes and configurations may be incorporated into the suspension clip without departing from the spirit and scope of the invention. For example, FIG. 5 illustrates an alternative hook 11*d* design formed by suitably cutting a flap into the flat material which forms a unitary clip 10*d*. The flap may be slightly bent so as to protrude from the surface of the device, thereby forming a suitable means for engaging the grid system.

Figure 4:
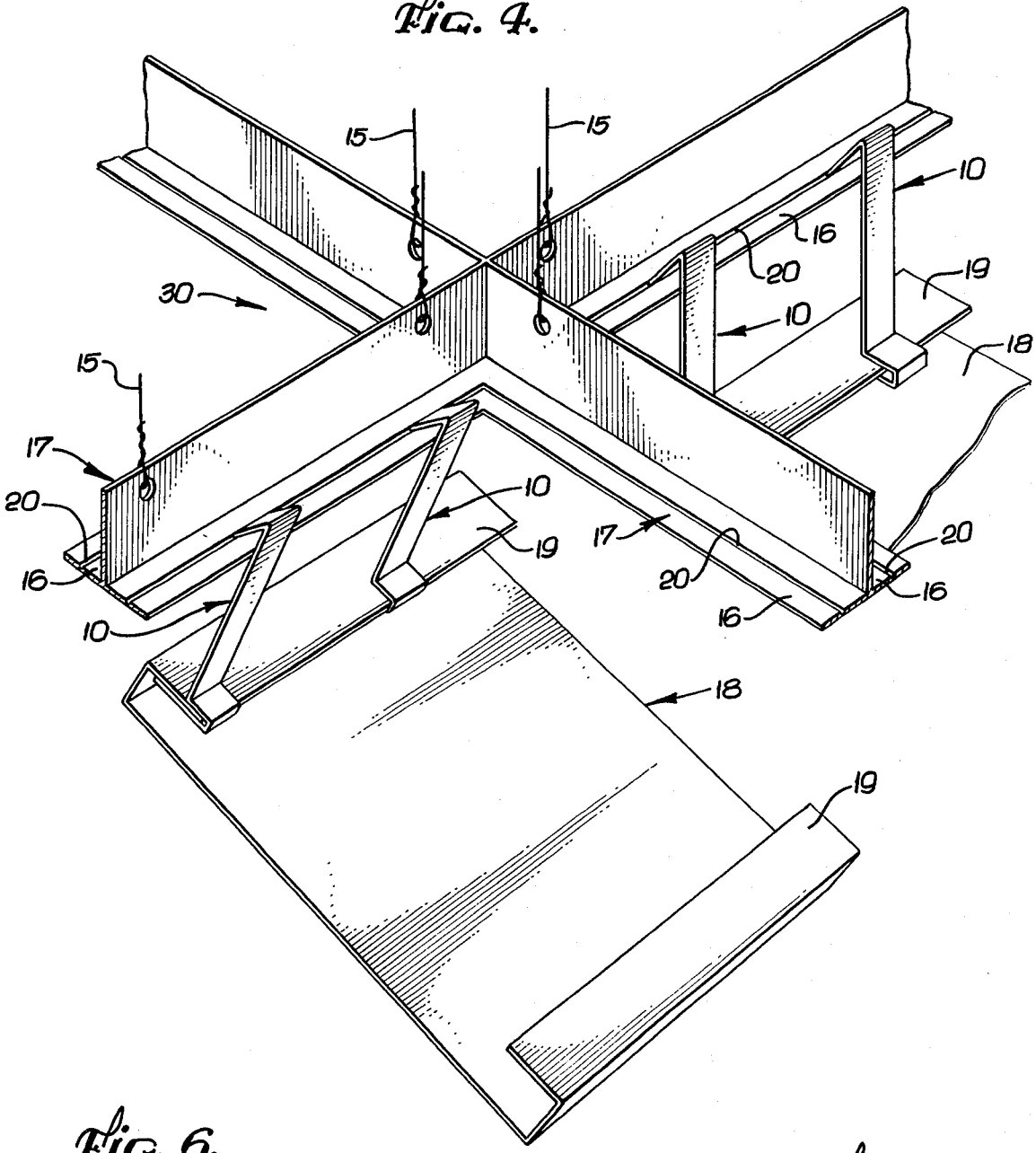
FIG. 4 is a perspective view of the embodiment shown in FIG. 1, illustrating the manner in which a ceiling panel may be retained along one side while allowing access above the normal position of the ceiling panel.

FIG. 4 is a perspective view of a panel system using the embodiment of the invention illustrated in FIG. 1. The inverted T-bar grid system 30 has an elongated depression 20 along each flange 16 of the T-bar beam 17. Such a depression 20 allows for the suitable retention of the ceiling panel 18 and associated panel clips 10 when the ceiling panel 18 is suspended only along one edge. As illustrated in FIG. 4, the ceiling panel may be rotated about the flange 16, to allow access above the T-bar grid system without completely disconnecting the ceiling panel 18 from the grid beam 17. Such an embodiment of the invention provides for convenient supporting of a ceiling panel while it is partially disengaged from the grid system.

Figure 6:
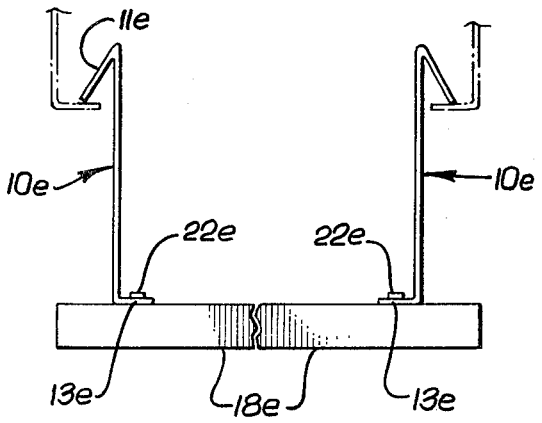
FIG. 6 is a side sectional view of yet another embodiment of the invention wherein the invention is fastened to the upper surface of a ceiling panel.

FIG. 6 illustrates yet another embodiment of the invention wherein the inventive device 10*e* has a horizontal tab 13*e* which may be fastened to the rear of a ceiling panel 18*e* via a fastener 22*e*, such as a screw or rivet. Since it is undesirable for the fastener to be visible, such an embodiment of the invention should preferably be used with a suitably thick ceiling panel, or with a thin ceiling panel if a suitable extension from the rear of the panel is provided for attachment purposes.

It is also contemplated that the hook end 11*b* of the embodiment shown in FIG. 6 may also be approximately a right angle rather than the acute angle shown. This configuration is possible for the other embodiments described herein as well.

Figure 7:
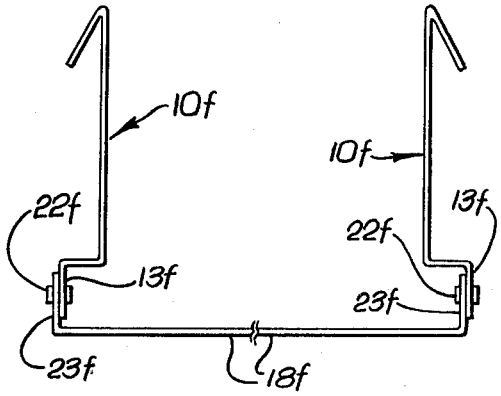
FIG. 7 is a side sectional view of still another embodiment of the invention whereby the inventive device is fastened to an edge of a ceiling panel.

FIG. 7 illustrates an alternative embodiment of the invention whereby the inventive device 10*f* has a vertical tab portion 13*f* which is suitably shaped for attaching an upwardly extending side 23*f* of the panel 18*f* via a suitable fastener 22*f* such as a screw, rivet, nut or bolt, or even by a bonding process such as welding, glueing, or soldering. The clip 10*f* may be attached to the side of the ceiling panel 18*f*, thus offering a means to suitably position the ceiling panel 18*f* below a grid system without visible hardware.

Figure 8:
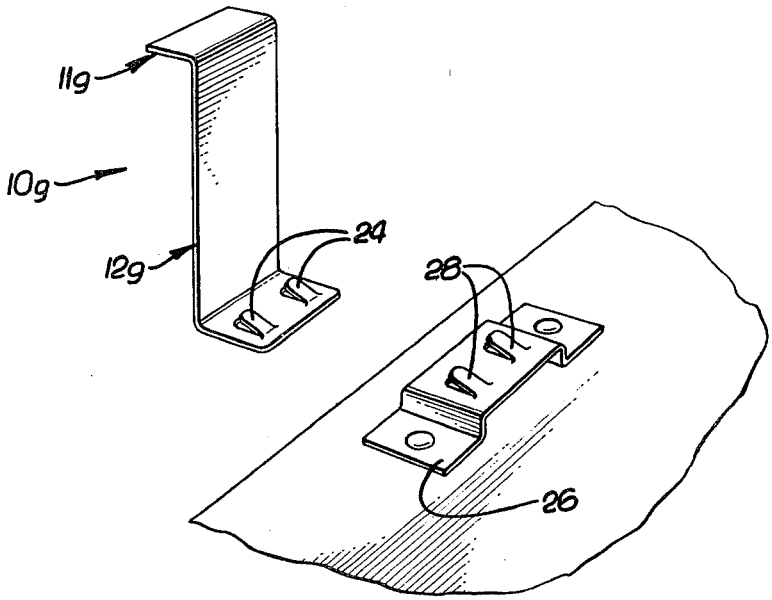
FIG. 8 is a perspective view of an embodiment of the invention utilizing a two-piece clip.

FIG. 8 shows an embodiment of the invention in which the clip 10*g* is a two-piece unit. One section is comprised of a vertical portion 12*g*, a flat hook portion 11*g*, and a partial clip portion 13*g*. The use of a flat portion enables the clip to be used with standard acoustical ceiling tile in place of the grid 17 (FIG. 2). The clip portion 13*g* has a pair of upwardly extending tabs 24. A bracket 26 is secured to a ceiling panel to be secured. The bracket 26 includes openings 28 which cooperate with the tabs 24. The clip portion 13*g* slips between the bracket 26 and panel in order to support the panel. The provision of a two-piece clip simplifies installation and does not require a hidden flange on the ceiling panel.

While only a limited number of embodiments of the disclosed invention have been discussed herein, it will be readily apparent to persons skilled in the art that changes and modifications may be made without departing from the spirit of the invention. For instance, the suspension clip may be made of any of a variety of materials, such as rubber, plastic, fiberglass, of metal; further, it need not be of unitary construction. Accordingly, the foregoing disclosure, description, and figures are for illustrative purposes only, and do not in any way limit the invention, which is defined only by the appended claims.

We claim:

1. A suspended ceiling panel system comprising:

a grid of T-bar support members for ceiling panels, each having a cross-section having a substantially symmetrical inverted T-shape configuration;

a plurality of ceiling panels for suspension from said T-bar support members; and sheet metal clip means for securing said panels to said T-bar support members, with the edges of said panels adjacent oneanother immediately below one of said T-bar support means;

said clip means being formed of a springy sheet metal strip material, and clip means on adjacent panels including oppositely facing hook means at adjacent panel edges for independently engaging the upper surfaces of laterally extending portions of one of said T-bar support members, and also including means for attaching said clip to said ceiling panels, and said clip means further including extension means between said hook means and said securing means for spacing said hook means and said securing means apart by a distance sufficient to provide manual access to the clip means of any panel when the adjacent panel is raised;

whereby a ceiling system is provided with concealed T-bar supports, uninterrupted fully exposed adjoining panels, and easy access to the space above the panels.

2. A system according to claim 1 wherein said clip means is of unitary construction.

3. A system according to claim 1 where said clip means comprises a flat springlike material, wherein said extension means is substantially perpendicular to the plane of said panel, wherein the extension means and the hook means are movable by the application of a force against said extension means to bend the extension means and disengage said device from said grid.

4. A system according to claim 1 wherein the clip means comprises a flat strip and wherein said hook means comprises a flap which is cut from a portion of said strip and bent to form an engaging protrusion from said material.

5. A system according to claim 1 wherein said attaching means comprises a clip formed by having an end of said material bent first at an angle of approximately 90 degrees to form one leg and then doubled back into near proximity with said leg to clamp a portion of said panel.

6. A device according to claim 1 wherein said attaching means comprises a tab attached to said extension means, said tab having a hole, wherein the tab cooperatively contacts an attachment portion of said panel, wherein a panel is secured to the device by means of a fastener inserted through said hole and into said panel.

7. A suspended ceiling panel system comprising: a grid of T-bar suppport members for ceiling panels, each having a cross-section having a substantially symmetrical inverted T-shape configuration;

a plurality of ceiling panels for suspension from said T-bar support members; and unitary flat strip clip means having first ends forming oppositely facing hook means at adjacent panels for independently engaging oppositely extending flanges of a T-bar support, said clip means formed at a second end thereof with a retaining means to retain edges of said panels and having a center extension means for separating said first end and said second end by an amount sufficient to give manual access to the clip means of any given panel when an adjacent panel is raised.

8. A system according to claim 7 wherein said clip means is configured such that when said clip means is clamped onto a panel edge, said center extension means is generally perpendicular to the plane of said panel.

9. A system according to claim 7 wherein said first end of said clip means is shaped to disengage from said grid when a force is applied against said center extension means in a direction substantially parallel to said panel and away from said grid.

10. A system according to claim 7 wherein said first end of said clip means rests upon an upper surface of the grid, thereby allowing said panel to be lifted toward said grid, thereby allowing access to clips supporting adjacent panels.

11. A system according to claim 7 wherein said grid system is an inverted T-bar system wherein the upper surfaces of flanges of the T-bar grids each contain an indentation and said hook engages said indentation, thereby securing said clip on said grid from lateral movement.

12. A system according to claim 7 wherein said grid includes a receptacle for the first end of said clip means, said clip means engaging said grid in said receptacle in a manner to permit said panel to be pivoted below said grid and held suspended from one edge by means of said clip without causing said clip to disengage from said grid.

13. A system according to claim 12 wherein the grid is an inverted T-bar type grid and said receptacle comprises a depression in the upper surfaces of the flanges of the grid.

14. A system according to claim 12 wherein said first end terminates in a boss-shaped member configured to securely engage said depression.

15. A clip according to claim 7 wherein said member is made of spring steel.

16. A clip according to claim 15 wherein said member comprises 26 gauge spring steel.

17. A system according to claim 1 wherein said grid system is an inverted T-bar system wherein the upper surfaces of flanges of the T-bar grids each contain an indentation and said hook engages said indentation, thereby securing said clip on said grid from lateral movement.

18. A system according to claim 1 wherein said grid includes a receptacle for the first end of said clip means, said clip means engaging said grid in said receptable in a manner to permit said panel to be pivoted below said grid and held suspended from one edge by means of said clip without causing said clip to disengage from said grid.

* * * * *